US008375765B2

(12) United States Patent
Schaltegger et al.

(10) Patent No.: US 8,375,765 B2
(45) Date of Patent: Feb. 19, 2013

(54) METHOD AND DEVICE FOR CONTROLLING THE SYNCHRONIZATION OF CYLINDER/PISTON UNITS AND FOR REDUCING PRESSURE PEAKS DURING FORMING AND/OR FINEBLANKING ON A FINEBLANKING OR STAMPING PRESS

(75) Inventors: Markus Schaltegger, Berne (CH); Thomas Winkler, Berne (CH); Francois Juhasz, Berne (CH)

(73) Assignee: Feintool Intellectual Property AG, Lyss (CH)

( * ) Notice: Subject to any disclaimer, the term of this patent is extended or adjusted under 35 U.S.C. 154(b) by 735 days.

(21) Appl. No.: 12/583,748

(22) Filed: Aug. 25, 2009

(65) Prior Publication Data

US 2010/0043519 A1 Feb. 25, 2010

(30) Foreign Application Priority Data

Aug. 25, 2008 (EP) ..... 08014958

(51) Int. Cl.
*B21J 7/14* (2006.01)
*B21J 9/18* (2006.01)

(52) U.S. Cl. ..... 72/453.13; 72/19.9; 72/453.11

(58) Field of Classification Search ..... 72/19.9, 72/453.05–453.06, 453.1, 453.11, 453.13
See application file for complete search history.

(56) References Cited

U.S. PATENT DOCUMENTS

| | | | | |
|---|---|---|---|---|
| 5,823,104 | A * | 10/1998 | Beisel et al. | 72/19.9 |
| 6,205,828 | B1 * | 3/2001 | Nagao et al. | 72/4 |
| 6,804,983 | B2 * | 10/2004 | Mori et al. | 72/453.13 |
| 7,827,843 | B2 * | 11/2010 | Arns et al. | 72/453.13 |
| 7,905,126 | B2 * | 3/2011 | Suzuki | 72/454 |
| 8,061,176 | B2 * | 11/2011 | Takayama et al. | 72/453.13 |
| 8,127,590 | B2 * | 3/2012 | Kohno et al. | 72/453.13 |

FOREIGN PATENT DOCUMENTS

| | | |
|---|---|---|
| DE | 1 427 403 | 11/1968 |
| DE | 2 148 618 | 4/1973 |
| DE | 23 60 821 | 5/1975 |
| DE | 26 21 726 | 12/1977 |
| DE | 28 12 973 | 2/1980 |
| DE | 31 12 393 | 10/1982 |
| DE | 41 25 992 | 2/1993 |

* cited by examiner

*Primary Examiner* — David B Jones
(74) *Attorney, Agent, or Firm* — Jordan and Hamburg LLP

(57) ABSTRACT

The cylinder/piston unit for a counterforce ram or vee ring of a fineblanking or stamping press equipped with at least one tool is continuously maintained at a preadjustable cushion pressure (P1) and is then subjected to a preadjustable displacement pressure (P2) from a connectable high-pressure source, with said pressure being set to a pressure (PU) varying between the cushion pressure (P1) and the pressure for forming or blanking by supplying a separate control oil quantity to a second accumulator via a central control unit, whereby a rise in pressure caused by the impact between the tool and the workpiece is regulated, independently of quantity of the control oil, from the pressure (P3) in the second accumulator to a permissible set pressure by discharging a significant part of the pressure pulse into a separate tank and the available cushion pressure allows ejection of the workpiece to be synchronized with retraction of the press ram.

10 Claims, 5 Drawing Sheets

METHOD AND DEVICE FOR CONTROLLING THE SYNCHRONIZATION OF CYLINDER/PISTON UNITS AND FOR REDUCING PRESSURE PEAKS DURING FORMING AND/OR FINEBLANKING ON A FINEBLANKING OR STAMPING PRESS

BACKGROUND OF THE INVENTION

The invention relates to a method for controlling the synchronization of cylinder/piston units for counterforce rams and/or vee rings and for reducing pressure peaks during the fineblanking and/or forming of workpieces on a fineblanking or stamping press equipped with at least one tool, in which the cylinder/piston unit is subjected to the control pressure of a hydraulic fluid and the press ram is driven mechanically or hydraulically.

The invention further relates to a device for controlling a piston/cylinder unit for the counterforce ram and vee ring and for reducing pressure peaks during the fineblanking of workpieces for implementation of the method with a fineblanking or stamping press, which is equipped with at least one tool consisting of an upper section and a lower section, which is allocated at least one piston/cylinder unit of the press for at least one counterforce ram and/or vee ring of the tool in addition to one press ram, and with a hydraulic system connected to the piston/cylinder unit, which comprises an accumulator for the storage of hydraulic fluid, hydraulic lines for the inlet and outlet of the hydraulic fluid to and from the piston/cylinder unit, controllable actuators for opening and closing the hydraulic lines and a control unit for activation of the actuators, whereby the press ram is either incorporated in the hydraulic system or connected to a separate drive system.

Fineblanking presses are known to be characterized in that the counterforce ram and the vee ring function as controlled axes and reach their limits in terms of process technology when operating at high cycle rates and fast speeds. The greater the cycle rates and speeds, the faster the pressure relief for the highly pressurized cylinder/piston units needs to be, also resulting in increasing impairment of the synchronization between the main ram of the press and the counterforce ram and vee ring cylinder due to the quantitative dependence of the pressure relief process (DE 2148618A1).

Pressure peaks are likewise known to occur during stamping or blanking on presses. Pressure surges can be observed for example with the so-called cutting shock, which occurs whenever the punch exits the workpiece and the resistance of the material is suddenly absent, or during the impact between the punch and the workpiece clamped between the upper section and lower section of the tool.

Numerous different solutions are known from the prior art, all attempting to reduce the cutting shock through dampening (DE 1 427 403 A, DE 26 21 726 A1, DE 28 12 973 A1, DE 31 12 393 C2, DE 41 25 992 A1).

DE 1 427 403 A1 describes a counterpressure system in a press designed to dampen the cutting shock, in particular in a hydraulic press, which consists of a counterpressure chamber filled with hydraulic fluid in at least one working unit consisting of a piston and cylinder in addition to at least one allocated exit restrictor.

Although this prior art is known to dampen the pressure surge of the cutting shock by means of the counterpressure system and discharge of the pressure pulse into a tank via the point of restriction, it is unable to pick up the pressure surge, which may attain values twice those of the force set during the impact between the punch and the workpiece. This subjects parts to undesirable deformation, quality impairment and increased tool wear.

DE 26 21 726 A1 describes a device designed to prevent cutting shock occurring on blanking presses with at least one cylinder/piston unit, which is positioned between a tool base plate and a press ram with an adjustable height level of a contact surface for the press ram, whereby the stroke of the piston is on the one hand limited by a collar provided on the cylinder and on the other, by the inner face wall of the cylinder facing the face of the piston, and whereby the pressurized medium chamber between the face of the piston and the face wall of the cylinder is connected in the inlet direction to a high-pressure pressurized medium source via a check valve and a pressure relief valve is connected in the outlet direction. The pressure relief valve is provided with a control chamber, which is connected to the high-pressure pressurized medium source, whereby the pressure in the control chamber can be adjusted via a control line by means of a central pressure control valve.

This prior art is likewise known to be unsuitable for reducing or preventing the pressure surge occurring during the impact between the punch and the workpiece, with the result that the disadvantages described above likewise apply to this known solution.

All these known solutions to reduce pressure peaks do not operate independently of quantity, thus not only resulting in speed differentials but also in pressure differentials in the cylinder chambers of the cylinder/piston units depending on the oil temperature.

DE 23 60 821 A1 describes a synchronization control system for hydraulic presses with a plurality of press pistons and a driver located between the high-pressure fluid source and the pressure chambers of the press pistons. The primary side of the driver, the working chamber, is supplied with a constant flow of the uncontrolled working fluid at a preset press piston operating speed and is actuated with a controlled cut-off valve.

This known solution is above all used for forging machines but cannot be applied to fineblanking.

SUMMARY OF THE INVENTION

Given this prior art, the basic object of the invention is to provide a method and a device for controlling the synchronization of cylinder/piston units and at least one main ram and for reducing pressure peaks during forming and/or fineblanking on fineblanking or stamping presses, which discharges any recoil caused by the impact between the punch and the workpiece, independently of quantity, from the controlling of the working pressure of the hydraulic fluid, bringing about a marked improvement in the synchronization properties of the cylinder/piston units and the main ram through a constant pressure characteristic in the hydraulic system including with high cycle times and speeds.

The method according to the invention is characterized in that first of all the cylinder/piston units are continuously maintained at a preadjustable cushion pressure by means of a first accumulator supplied from a low-pressure source and that the cylinder/piston units are then subjected to a preadjustable displacement pressure from a connectable high-pressure source, with said pressure being set to a pressure varying between cushion pressure and pressure for forming and/or blanking by supplying a separate control oil quantity to a second accumulator via a central control unit, whereby a rise in pressure caused by the impact between the tool and the workpiece is regulated, independently of quantity, from the pressure to a permissible set pressure by discharging a significant part of the pressure pulse into a separate tank, and that the available cushion pressure allows ejection of the workpiece to be synchronized with retraction of the press ram.

With the method according to the invention the first accumulator is first of all charged during rapid traverse of the plunger to the cushion pressure corresponding to the clamping force of the workpiece in the die of the tool, which is equal to the ejection force of the counterforce ram. This continuously acts on the cylinder/piston unit. The cylinder/piston unit is then charged to displacement pressure from a high-pressure source, whereby this pressure level is preset by a proportional pressure valve.

A second accumulator which operates independently of the first accumulator is then charged by means of a separate control oil quantity to a pressure level which must be delivered by the counterforce ram and/or vee ring during forming. The counterforce ram and/or vee ring extend with the low pressure available from the first accumulator.

Once the counterforce ram and/or vee ring have extended, the hydraulic high-pressure source is connected and the counterforce ram and/or vee ring charged to displacement pressure.

As soon as the punch strikes the workpiece, the resulting pressure peaks are discharged into a separate tank, leaving a set pressure defined as being permissible.

The counterforce ram and/or vee ring are displaced and the cylinder/piston unit of the counterforce ram and/or the vee ring are relieved to cushion pressure. Synchronized ejection of the counterforce ram and/or the vee ring takes place on retraction of the press ram, whereby the return speed of the press ram has a value that is equal to the ejection speed of the counterforce ram.

The method according to the invention has the special advantage that movement of the counterforce ram and/or vee ring can be synchronized with or against the action of the press ram without any fall-off or increase in the force exerted by the piston.

The control system operates independently of quantity, so resulting in more constant pressure characteristics including under different conditions.

The displacement pressure remains stable in particular with high displacement pressures and/or long hydraulic lines, i.e. despite any drop in pressure in the accumulator the external control oil supply ensures that the control pressure in the displacement valve remains constant. The control pressure supply from the separate circuit makes sure that the maximum displacement force is provided for the counterforce ram and/or vee ring including with the selection of a low pressing force.

Another advantage here is that the method according to the invention is equally suitable for both hydraulically and mechanically driven presses.

The device according to the invention has a simple and compact design and offers the major advantage that the cylinder/piston unit is connected to two hydraulic circuits that operate independently of each other. In other words, the cylinder/piston unit is on the one hand connected to a cushion pressure circuit maintained at low pressure by a low-pressure source and on the other, to a high-pressure displacement circuit which can be cut in. The cushion pressure circuit continuously maintains the cylinder/piston unit at a pressure that is equal to the ejection force of the counterforce ram, and the displacement circuit subjects the counterforce ram and/or vee ring to a force with a more or less constant pressure.

The cylinder/piston unit is connected with the low-pressure source via a first proportional valve, which can be programmed by a control unit, to a first accumulator for the generation of a cushion pressure continuously present at the piston/cylinder unit which is specified by the proportional valve. The high-pressure source is connected to the piston/cylinder unit via a proportional valve programmed by the control unit and pilot-operated by a proportional way valve and a second accumulator for the generation of pressure for the counterforce ram and/or vee ring, whereby the proportional way valve is connected to a separate tank for the discharge of pressure peaks. The second accumulator is connected to a control oil pump, which conveys hydraulic fluid to the second accumulator in order to keep the pressure in the second accumulator at a constant level. A two-way valve serves to connect either the cushion pressure circuit or the displacement pressure circuit to the cylinder/piston unit, whereby a check valve separates the cushion pressure circuit from the displacement pressure circuit.

The method according to the invention and the device according to the invention are characterized by the cylinder/piston units being largely synchronized with the press ram, so allowing high cycle rates and speeds to be achieved. In addition, there is a massive reduction in the susceptibility to pressure peaks during the impact between the tool and the workpiece, so allowing deformation, quality impairment and tool wear to be significantly minimized including with high cycle rates.

Further advantages and details can be found in the following description with reference to the attached drawings.

The invention is explained in greater detail below by means of an embodiment.

DETAILED DESCRIPTION OF THE INVENTION

Figure 1:
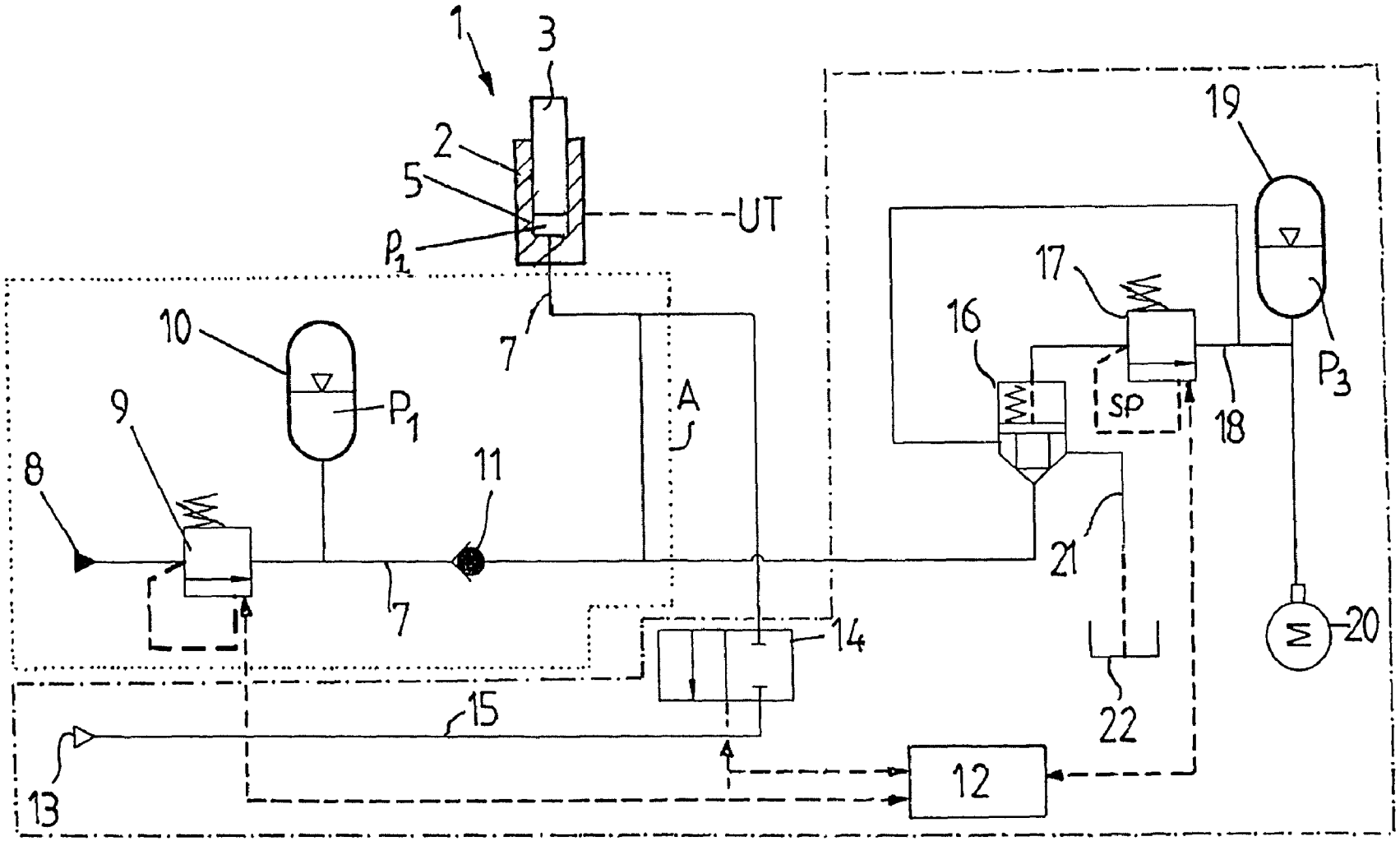
FIG. 1 shows a schematic view of the process step "Charging cushion pressure"
Figure 2:
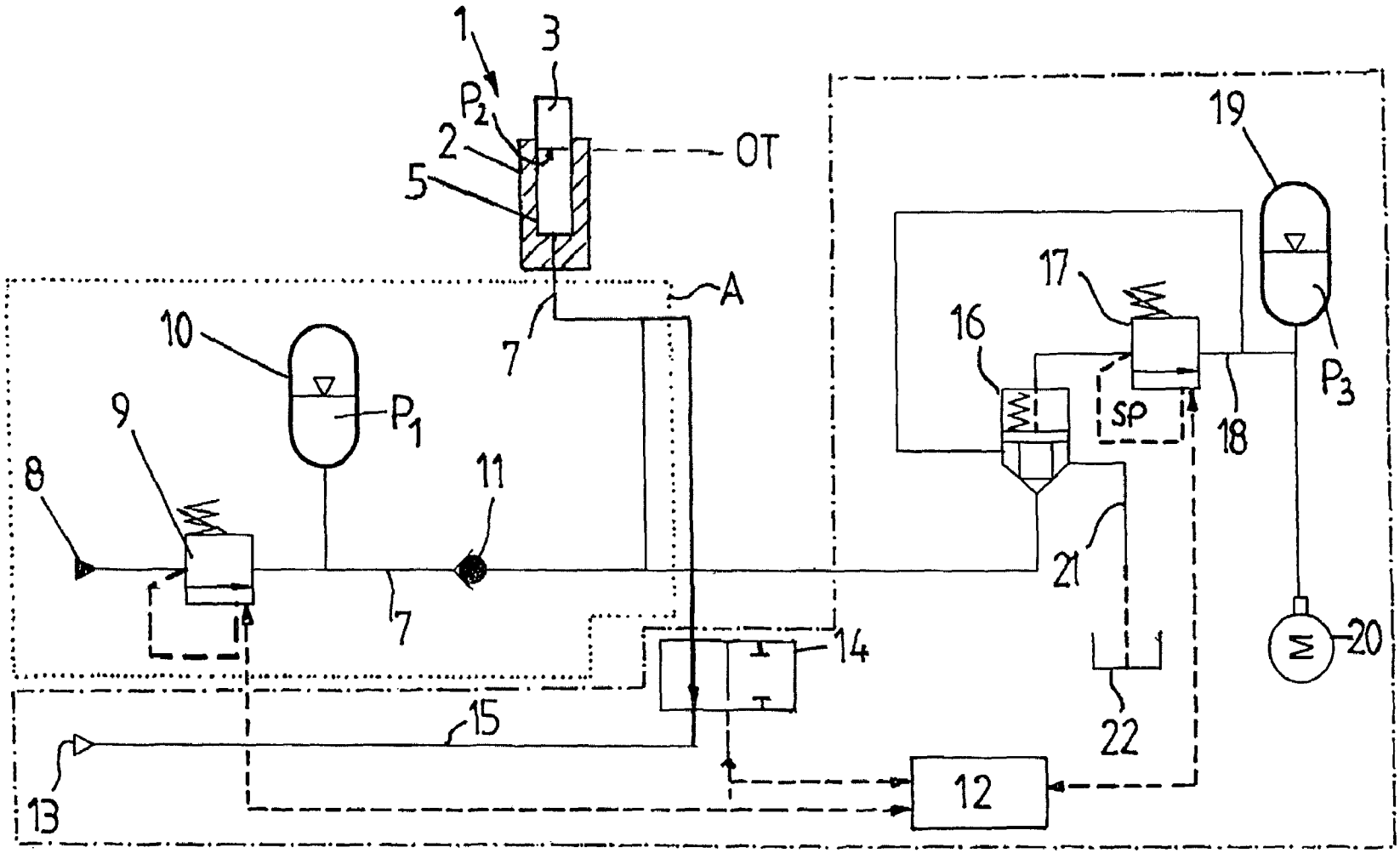
FIG. 2 shows a schematic view of the process step "Charging displacement pressure"

FIG. 1 shows the fundamental structure of the device according to the invention, which is to be used to apply the method according to the invention on a fineblanking press for the forming/fineblanking of parts. The cylinder/piston unit 1 is for example equipped with a piston 3 positioned in a counterforce cylinder 2. The working chamber 5 of the cylinder/piston unit 1 is connected to a low-pressure source 8 by a hydraulic line 7.

When looking from the low-pressure source 8, the hydraulic line 7 leads to the cylinder/piston unit 1 via a proportional pressure valve 9, a first accumulator 10 and a check valve 11. The proportional pressure valve 9 is also connected to a central control unit 12, which can be used to program the proportional pressure valve 9 to a corresponding cushion pressure P1. The piston 3 of the counterforce cylinder 2 in the press (not shown) is in rapid traverse, i.e. the piston is first moving from bottom dead centre UT towards top dead centre OT. The low-pressure source 8, proportional pressure valve 9, accumulator 10, check valve 11 and the associated hydraulic line 7 form the hydraulic cushion pressure circuit A for the cylinder/piston unit 1.

The working chamber 5 of the cylinder/piston unit 1 is also connected to a high-pressure source 13 via a hydraulic line 15 with a two-way valve 14. The two-way valve 14 serves to connect the high-pressure source 13 to the working chamber 5. In this case the hydraulic line 7 is blocked by the check valve 11 so that the low-pressure source 8 is reliably separated from the high-pressure source 13.

Upstream the hydraulic line 7 leads to a 4-way piston valve 16, for example a proportional way valve, used to preregulate a second proportional pressure valve 17 to a specific permissible set pressure SP. On the input side a hydraulic line 18 connects the proportional pressure valve 17 to a second accumulator 19, which is supplied with control oil by a separate control oil pump 20.

On the output side a hydraulic line 21 connects the 4-way piston valve 16 to a separate tank 22, which takes up the hydraulic fluid displaced by the pressure peaks.

The high-pressure source 13, two-way valve 14, 4-way piston valve 16, proportional pressure valve 17, second accumulator 19 and the associated hydraulic lines 18 form the hydraulic displacement pressure circuit B for the cylinder/piston unit 1. The accumulators 10 and 19 are designed as bladder accumulators.

The method according to the invention takes place as follows in the steps shown in FIGS. 1 to 4.

The plunger of the cylinder/piston unit 1 is located close to bottom dead centre and is in rapid traverse. In the first step the first accumulator 10 is charged from the low-pressure source 8 to a cushion pressure P1 corresponding to the clamping force of the workpiece, which is equal to the ejection force of the counterforce ram.

Once the first accumulator 10 has reached the cushion pressure P1, the cushion pressure P1 acts on the working chamber 5 of the counterforce cylinder and the counterforce ram extends to top dead centre OT at the available low pressure. At the same time as the counterforce ram extends to top dead centre OT, the second accumulator 19 is charged to the displacement pressure P2, which is preset via the proportional pressure valve 17. Programming of the proportional pressure valve 17 to different displacement pressures is via the central control unit 12.

In the second step (cf. FIG. 2) the highly pressurized hydraulic fluid from the high-pressure source 13 is connected to the working chamber 5 by switching the two-way valve 14, which is in the closed position during the first step. This initiates charging of the working chamber 5 to the displacement pressure P2 preset by the proportional pressure valve 17.

The proportional pressure valve 17 is adjusted accordingly by the central control unit 12. The counterforce ram is thus subjected to the displacement pressure P2. The two-way valve 14 is closed by a corresponding command from the control unit 12.

Figure 3:
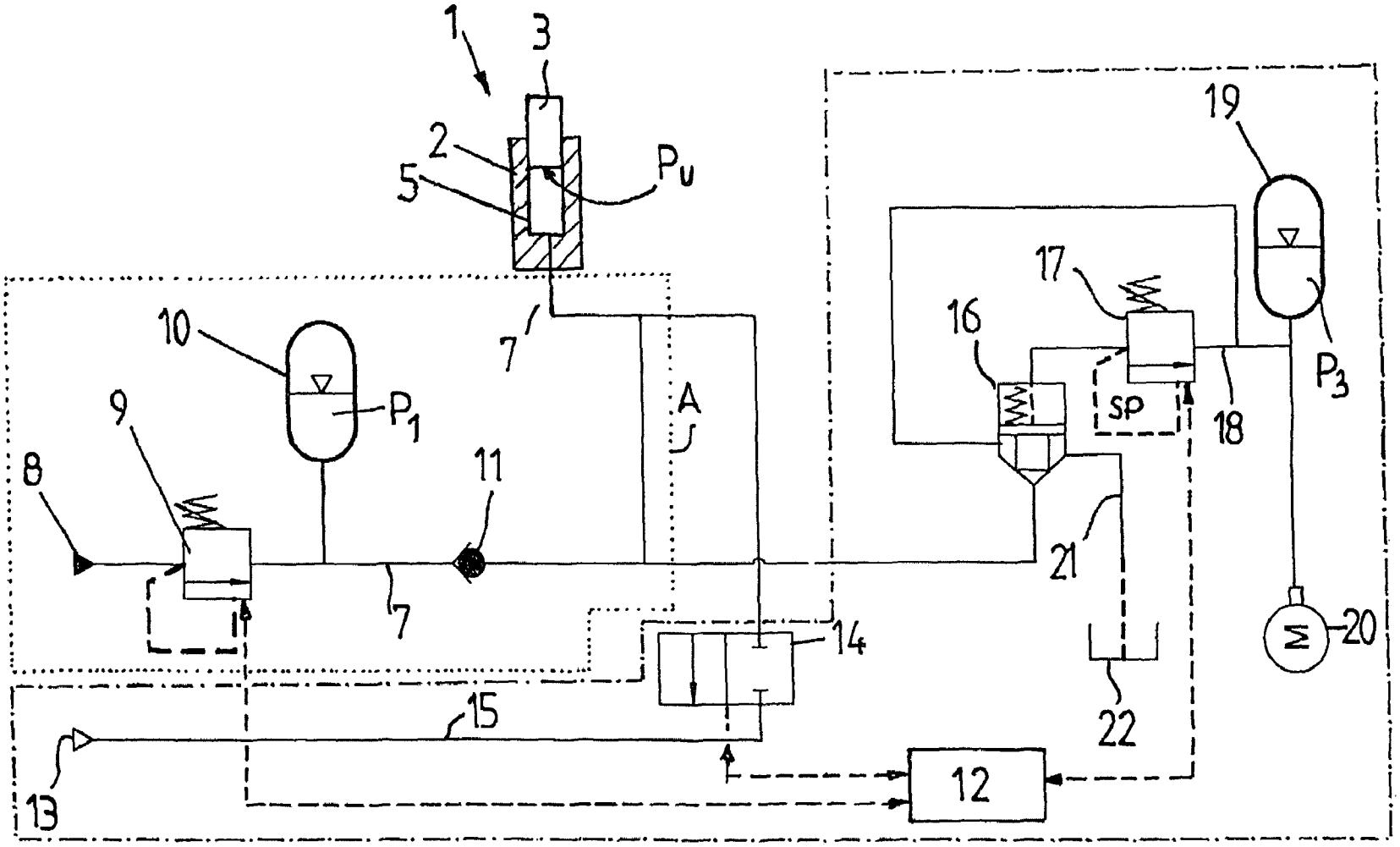
FIG. 3 shows a schematic view of the process step "Fineblanking/forming"

FIG. 3 shows a schematic view of the third step of the process. The two-way valve 14 has switched to cut off the high-pressure source 13. The displacement pressure P2 acting on the counterforce ram is effectively hydraulically balanced with the pressure generated in the second accumulator 19 and can take on values varying between cushion pressure and the pressure PU necessary for forming or fineblanking.

At the start of forming or fineblanking the tool, for example the punch, strikes the workpiece, for example strip stock. The impact results in a pressure peak, which may attain values twice those of the force set for forming/blanking. The pressure pulse resulting from the pressure peak passes along the hydraulic line 7 to reach the 4-way piston valve 16, which regulates the pressure pulse to a permissible set pressure SP and discharges it into the tank 22 via the hydraulic line 21. This reduces the effect of the resulting pressure peak on the workpiece.

The pressure in the second accumulator 19 is kept more or less constant by supplying a corresponding quantity of control oil from a separate control oil source via the control oil pump 20.

Figure 4:
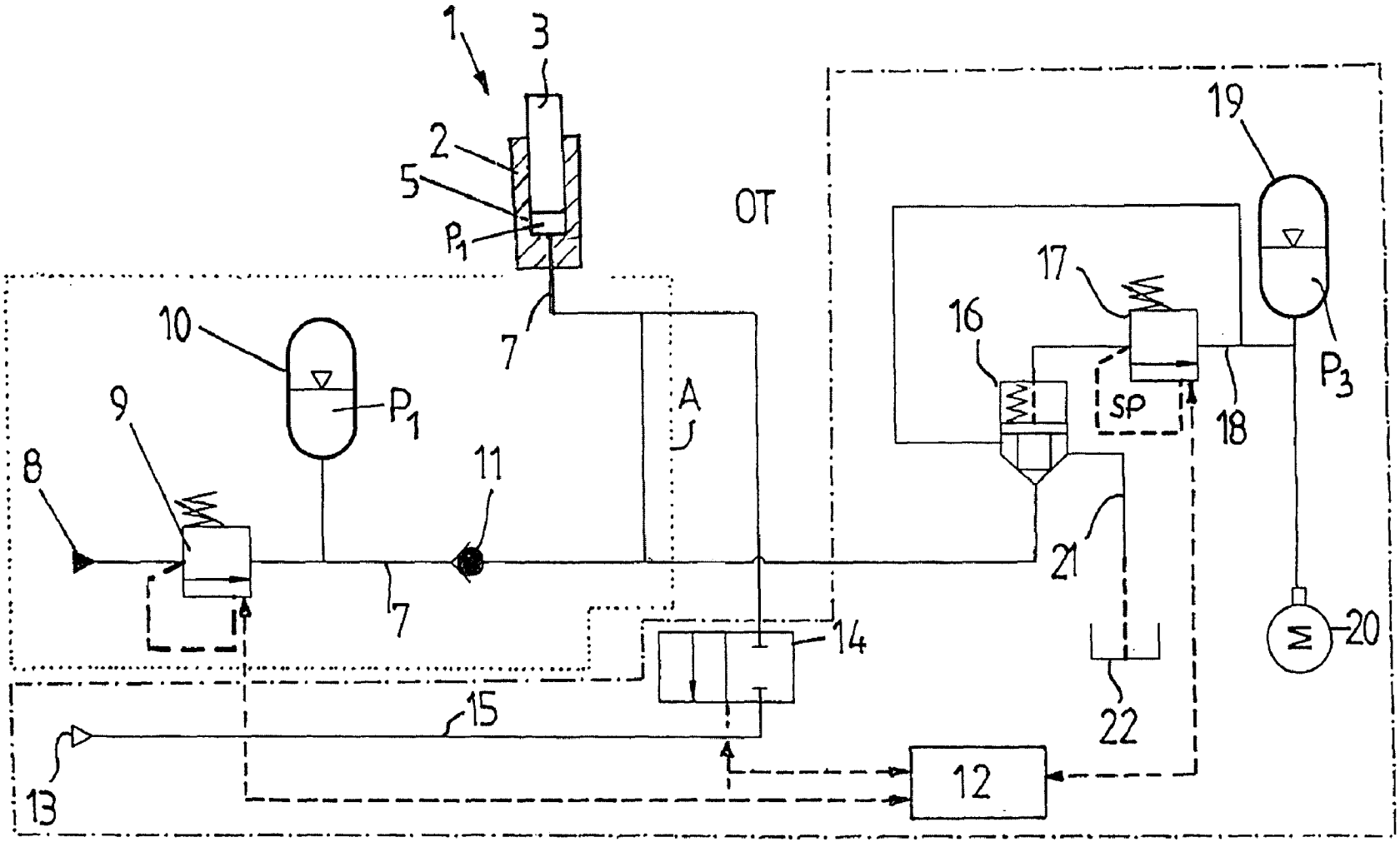
FIG. 4 shows a schematic view of the process step "Displacement at top dead centre"

As can be seen in FIG. 4, the plunger of the counterforce cylinder 2 of the cylinder/piston unit 1 is located at top dead centre OT in the fourth step of the process. The counterforce ram is displaced.

It is only possible to reduce the level of displacement pressure P2 acting on the working chamber 5/6 to the cushion pressure P1 from the first accumulator 10 which is still present. This means that the working chamber 5 is continuously subjected to the cushion pressure P1. The cylinder/piston unit 1 behaves like a mechanical spring, so allowing it to move against or with the action of the press ram.

Figure 5:
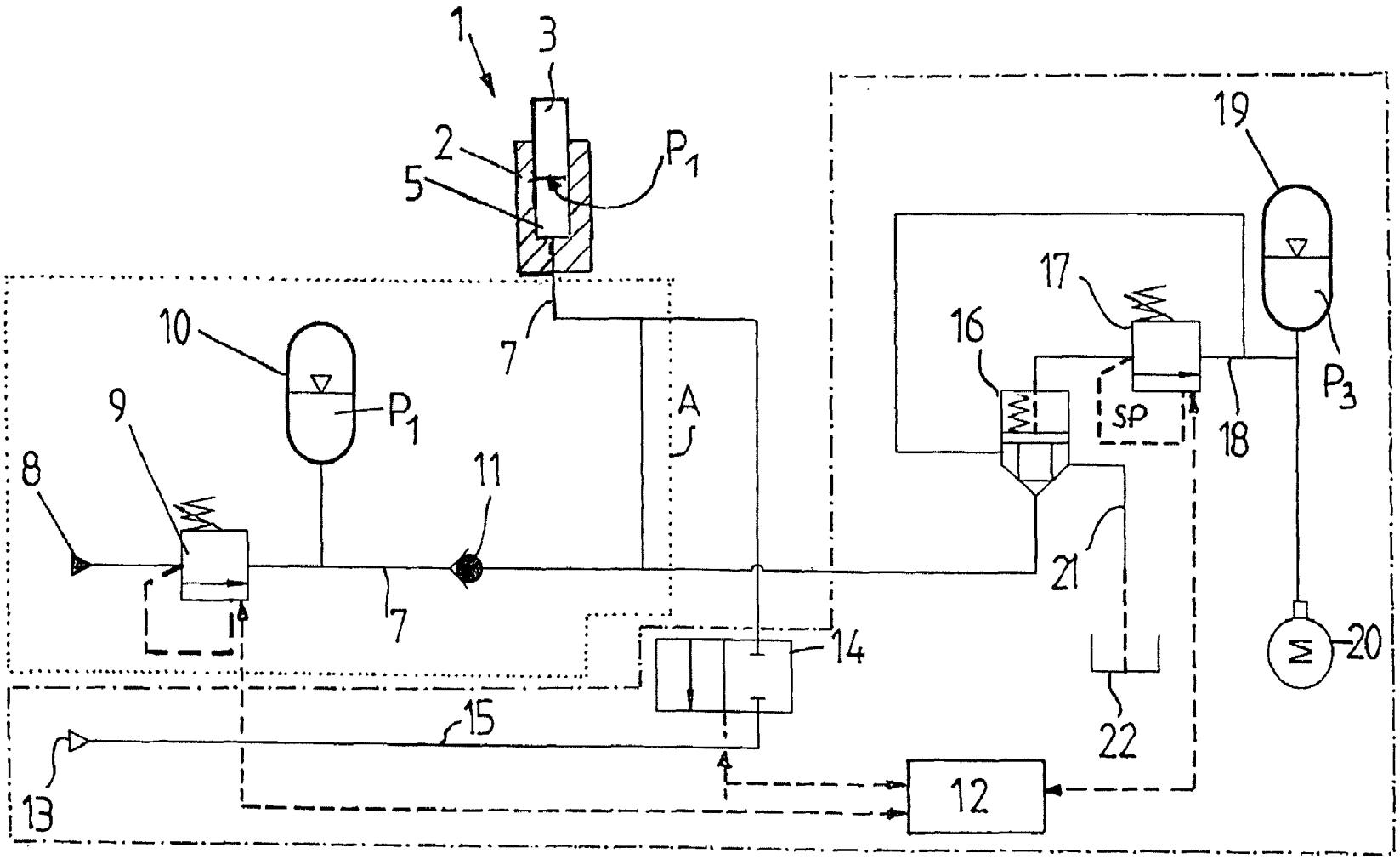
FIG. 5 shows a schematic view of the process step "Synchronous ejection".

The fifth step of the process is shown in FIG. 5. The presence of the cushion pressure P1 ensures that retraction of the press ram is synchronized with ejection of the counterforce ram. Here the ejection speed of the counterforce ram must be adjusted so that the return speed of the press ram is equal to the ejection speed. The ejection force must moreover correspond to the retaining force of the workpiece in the die. If the ejection speed is too low, the workpiece will tear away from the stock of material because the ejection force has been set too low. If, on the other hand, the ejection speed is too high, the workpiece will be rammed into the stock and so damaged because the ejection force has been set too high.

This means that precise adjustment of the cushion pressure P1 is important for synchronizing ejection with retraction of the press ram. The proportional pressure valve 9 must therefore be preset accordingly by the central control unit 12.

The above explanations equally apply to the cylinder/piston unit of the vee ring.

The invention claimed is:

1. A method for controlling a cylinder/piston unit of a counterforce ram in a fineblanking or stamping press having a press ram and said counterforce ram, the method synchronizing the cylinder/piston unit with the press ram in a manner for reducing a pressure peak occurring at impact between a tool of the fineblanking or stamping press and a workpiece during a fineblanking or stamping operation, wherein the tool comprises a die, and the press ram is driven mechanically or hydraulically, comprising:

continuously maintaining, using a first accumulator, a cushion pressure applied to the cylinder/piston unit from a low-pressure source, wherein the cushion pressure is preadjustable;

subjecting the cylinder/piston unit, using a second accumulator, to a displacement pressure from a connectable high-pressure source to vary pressure in the cylinder/piston unit between the cushion pressure and an increased pressure for performing fineblanking or stamping;

setting the preadjustable cushion pressure by supplying first control hydraulic fluid to the first accumulator;

setting the preadjustable displacement pressure, using a control unit, by supplying second control hydraulic fluid to the second accumulator; and regulating a pressure pulse, attributable to an impact between the tool and the workpiece, independently of a quantity of the second control hydraulic fluid being supplied to said second accumulator by discharging an amount of the second control hydraulic fluid in accordance with an amplitude of the pressure pulse into a second tank that is separate from a fluid source tank that supplies the second accumulator with the second control hydraulic fluid; and wherein a total pressure in the cylinder/piston unit is maintained during the fineblanking or stamping operation to be at least the cushion pressure, is increased above the cushion pressure for an impending impact between said tool and said workpiece, and is regulated at impact to reduce effects of said pressure peak on the workpiece; and wherein maintaining said cushion pressure during the fineblanking or stamping operation allows ejection of the counterforce ram to be synchronized with retraction of the press ram.

2. The method of claim 1, further comprising the following steps:

charging of the first accumulator during rapid traverse of the piston to the cushion pressure (corresponding to clamping force of the workpiece in the die of the tool, which is equal to ejection force of the counterforce ram;

charging of the second accumulator operating independently of the first accumulator by means of a separate control oil quantity to the displacement pressure which is delivered by the counterforce ram during the forming;

extending the counterforce ram with low pressure;

connecting the hydraulic high-pressure source and charging the counterforce ram to the displacement pressure;

discharging of the pressure pulse resulting from the impact between the punch and the workpiece to a set pressure defined as being permissible (SP) into the separate tank;

displacing the counterforce ram and relieving pressure of the cylinder of the counterforce ram to the pressure in accordance with said first accumulator charging; and synchronizing ejection speed of the counterforce ram on retraction of the press ram, whereby the return speed of the press ram is set to a value that is equal to the ejection speed of the counterforce ram.

3. The method of claim 1, further comprising adjusting the cushion pressure in the first accumulator by a proportional pressure valve, the proportional control valve being programmable by the central control unit.

4. The method of claim 1, further comprising adjusting the displacement pressure in the second accumulator by a further proportional valve and pilot operating the further proportional valve by a piston valve.

5. The method of claim 4, further comprising adjusting the set pressure during the impact between the tool and the workpiece by a 4-way piston valve.

6. The method of claim 5, wherein the 4-way piston valve comprises a proportional pressure valve and regulates the rise in pressure to the predefined set pressure during the impact between the tool and the workpiece, whereby the pressure remains substantially constant.

7. The method of claim 1, further comprising connecting the high-pressure hydraulic source by a two-way valve once the pressure has been reached in the first accumulator.

8. The method of claim 1, wherein the accumulators comprise bladder accumulators.

9. An apparatus for controlling a cylinder/piston unit of a counterforce ram in a fineblanking or stamping press having a press ram and said counterforce ram, the apparatus synchronizing the cylinder/piston unit with the press ram in a manner for reducing a pressure peak occurring at impact between a tool of the fineblanking or stamping press and a workpiece during a fineblanking or stamping operation, wherein the tool comprises a die, and the press ram is driven mechanically or hydraulically, the apparatus comprising:

hydraulic lines for inlet and outlet of hydraulic fluid to and from the piston/cylinder unit;

controllable actuators for opening and closing the hydraulic lines;

a control unit for activation of the actuators;

a hydraulic cushion pressure circuit; and a hydraulic displacement pressure circuit; and wherein the hydraulic cushion pressure circuit maintains a cushion pressure at the cylinder/piston unit and comprises:

a first pressure source;

a first proportional pressure valve that is coupled to the first pressure source and is programmable by the control unit for preadjusting the cushion pressure;

a first accumulator for regulating the cushion pressure; and a check valve;

wherein the hydraulic displacement pressure circuit increases pressure at the cylinder/piston unit above the cushion pressure to a displacement pressure acting on the counterforce ram, and comprises:

a second pressure source that supplies a pressure greater than a pressure supplied by the first pressure source, wherein the second pressure source is separated from the first accumulator by the check valve;

a two-way valve between the second pressure source and the cylinder/piston unit that actuates whether pressure is supplied from said second pressure source to said cylinder/piston unit;

a second accumulator for regulating the pressure supplied from the second pressure source;

a control fluid source tank that supplies control fluid to the second accumulator;

a 4-way piston valve;

a second proportional pressure valve that is coupled to the cylinder/piston unit, is programmable by the control unit for preadjusting the displacement pressure, and is pilot-operated to a set pressure by the 4-way piston valve; and a pressure pulse overflow tank; and wherein the 4-way piston valve is programmable by the control unit for regulating a pressure pulse, attributable to an impact between the tool and the workpiece, independent of a quantity of the control fluid supplied to said second accumulator, by discharging into the pressure pulse overflow tank an amount of the control fluid in accordance with an amplitude of the pressure pulse.

10. The apparatus of claim 9, wherein the accumulators comprise bladder accumulators.

* * * * *